US008464485B2

(12) United States Patent
Hilburn

(10) Patent No.: US 8,464,485 B2
(45) Date of Patent: Jun. 18, 2013

(54) FIRE RESISTIVE JOINT COVER SYSTEM

(75) Inventor: Johnnie Daniel Hilburn, Wichita, KS (US)

(73) Assignee: Balco, Inc., Wichita, KS (US)

( * ) Notice: Subject to any disclaimer, the term of this patent is extended or adjusted under 35 U.S.C. 154(b) by 0 days.

(21) Appl. No.: 13/115,675

(22) Filed: May 25, 2011

(65) Prior Publication Data

US 2012/0297709 A1 Nov. 29, 2012

(51) Int. Cl.

| | |
|---|---|
| ***E04B 1/94*** | (2006.01) |
| ***E04B 1/68*** | (2006.01) |
| ***E04B 1/62*** | (2006.01) |

(52) U.S. Cl.

USPC ..... 52/396.01; 52/317; 52/394; 52/393

(58) Field of Classification Search

USPC ..... 52/317, 394, 393, 396.01, 396.03, 52/402, 232, 396.04

See application file for complete search history.

(56) References Cited

U.S. PATENT DOCUMENTS

| | | | | |
|---|---|---|---|---|
| 3,363,383 | A | 1/1968 | La Barge | |
| 3,371,456 | A | 3/1968 | Balzer et al. | |
| 3,750,359 | A * | 8/1973 | Balzer et al. | 52/468 |
| 4,566,242 | A | 1/1986 | Dunsworth | |
| 4,622,251 | A | 11/1986 | Gibb | |
| 4,756,945 | A | 7/1988 | Gibb | |
| 4,942,710 | A * | 7/1990 | Rumsey | 52/396.01 |
| 5,501,045 | A | 3/1996 | Wexler | |
| 5,765,332 | A | 6/1998 | Landin et al. | |
| 5,875,598 | A | 3/1999 | Batten et al. | |
| 5,974,750 | A | 11/1999 | Landin et al. | |
| 6,128,874 | A | 10/2000 | Olsen et al. | |
| 6,131,352 | A * | 10/2000 | Barnes et al. | 52/396.01 |
| 6,207,085 | B1 | 3/2001 | Ackerman | |
| 6,207,089 | B1 | 3/2001 | Chuang | |
| 6,253,514 | B1 * | 7/2001 | Jobe et al. | 52/471 |
| 6,996,944 | B2 | 2/2006 | Shaw | |
| 7,856,781 | B2 * | 12/2010 | Hilburn, Jr. | 52/394 |
| 8,079,190 | B2 * | 12/2011 | Hilburn, Jr. | 52/394 |
| 2008/0172960 | A1 * | 7/2008 | Hilburn | 52/232 |
| 2011/0083383 | A1 * | 4/2011 | Hilburn, Jr. | 52/232 |

OTHER PUBLICATIONS

Metacaulk; Joint Systems: System No. FF-D-0053; Jun. 23, 2005; www.rectorseal.com/firestopping/ulsystems/ff-d-0053.html.

Metacaulk; Joint Systems: System No. WW-D-0054; Apr. 19, 2005; www.rectorseal.com/firestopping/ulsystems/ww-d-0054.html.

(Continued)

*Primary Examiner* — Mark Wendell

(74) *Attorney, Agent, or Firm* — Hovey Williams LLP

(57) ABSTRACT

A joint cover system is operable to span a gap between two building members, wherein each building member including a first side surface and an end surface. The joint cover system comprises a first base member, a second base member, an intumescent sheet, a first fastener, and a second fastener. The first base member may be positioned on the first side surface of the first building member, and the second base member may be positioned on the first side surface of the second building member. The intumescent sheet may include a first edge positioned between the first base member and the first side surface of the first building member and a second edge positioned between the second base member and the first side surface of the second building member. The first fastener may penetrate the first base member and the first edge of the intumescent sheet. The second fastener may penetrate the second base member and the second edge of the intumescent sheet.

5 Claims, 4 Drawing Sheets

OTHER PUBLICATIONS

Metacaulk; Joint Systems: System No. WW-D-0056; Jun. 8, 2006; www.rectorseal.com/firestopping/ulsystems/ww-d-0056.html.
Metacaulk; Joint Systems: System No. WW-S-0037; Apr. 19, 2005; www.rectorseal.com/firestopping/ulsystems/ww-s-0037.html.
Metacaulk; BlazeSeal; Fire Door Strip Oct. 2002 Product Data Sheet.
UniFrax; Product Information Sheet; FyreWrap XFP Expanding Paper.
U.S. Appl. No. 11/625,174, filed Jan. 19, 2007, Hilburn.

* cited by examiner

FIRE RESISTIVE JOINT COVER SYSTEM

BACKGROUND OF THE INVENTION

1. Field of the Invention

Embodiments of the present invention relate to fire resistive joint cover systems. More particularly, embodiments of the present invention relate to fire resistive joint cover systems including a fire-resistive sheet.

2. Description of the Related Art

Joints are often formed where there is a gap between two building members, such as two wall sections, a wall section and a ceiling, a wall section and a floor, and the like. It is desirable to cover the gap while at the same time provide a barrier to fire spreading through the gap.

SUMMARY OF THE INVENTION

Embodiments of the present invention provide a distinct advance in the art of fire resistive joint cover systems. More particularly, embodiments of the invention provide a joint cover system that includes an intumescent sheet positioned within a gap between two building members.

Embodiments of the joint cover system are operable to span a gap between two building members wherein each building member including a first side surface and an end surface. The joint cover system comprise a first base member, a second base member, a cover plate, an intumescent sheet, a first fastener, and a second fastener. The first base member may be positioned on the first side surface of the first building member. The second base member may be positioned on the first side surface of the second building member. The first and second base members may both include a slot and the cover plate may be slidably positioned within each slot.

The intumescent sheet may include a first edge positioned between the first base member and the first side surface of the first building member, a second edge positioned between the second base member and the first side surface of the second building member, and an intermediate portion that spans the gap between the building members. The first fastener may penetrate a portion of the first base member, the first edge of the intumescent sheet, and the first side surface of the first building member. The second fastener may penetrate a portion of the second base member, the second edge of the intumescent sheet, and the first side surface of the second building member.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
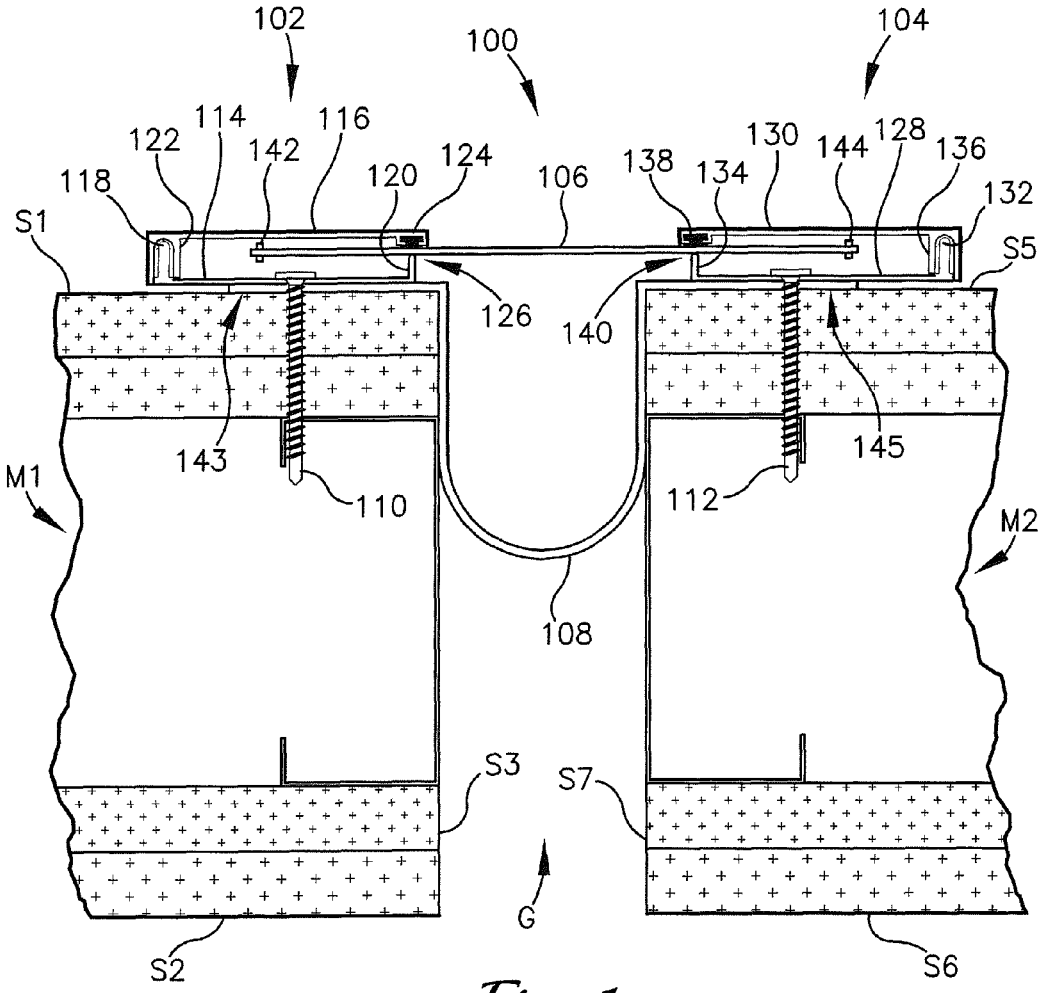
FIG. 1 is a sectional view of a fire resistive joint cover system constructed in accordance with a first embodiment of the present invention and shown installed in a gap between two building members.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

A fire resistive joint cover system 100, constructed in accordance with a first embodiment of the present invention, is shown in FIG. 1. The joint cover system 100 may be installed to cover a gap G between a first building member M1 and a second building member M2. The building members M1, M2 may include wall sections, ceilings, floors, and the like. The gap G may include the space between two wall sections, a wall section and a ceiling, and a wall section and a floor. For example, as shown in FIG. 1, the gap G may be between two building members M1, M2 that are wall sections, as seen from one edge of the wall sections, either the top edge looking down or the bottom edge looking up.

The first building member M1 may include a first side surface S1, a spaced-apart second side surface S2, a first end surface S3, and a spaced-apart second end surface S4 (not shown in the figures). The first and second end surfaces S3, S4 are generally positioned at opposing ends of the first and second side surfaces S1, S2. The first side surface S1 may face a first open space, such as a room, and the second side surface S2 may face a second open space, such as a different room or a hallway.

The second building member M2 may be substantially similar to the first building member M1 and may include a first side surface S5, a spaced-apart second side surface S6, a first end surface S7, and a spaced-apart second end surface S8 (not shown in the figures). As with the first building member M1 surfaces, the first and second end surfaces S7, S8 are generally positioned at opposing ends of the first and second side surfaces S5, S6.

In some embodiments, the gap G may be formed between the first end surfaces S3, S7 of the first and second building members M1, M2. In other embodiments, shown in FIG. 3-4 and discussed in more detail below, the gap G may be formed between the first end surface S3 of the first building member M1 and the first side surface S5 of the second building member M2.

The joint cover system 100 is generally sized to accommodate the dimensions of the building members M1, M2 between which the gap G is formed. For example, if the two building members M1, M2 are wall sections, then the length of the joint cover system 100 would be approximately equal to the height of the wall sections, from the floor to the ceiling. The joint cover system 100 may broadly comprise a first base member 102, a second base member 104, a first cover plate 106, a first intumescent sheet 108, a first fastener 110, and a second fastener 112.

The first base member 102 may include a lower stage member 114 and an upper stage member 116. The lower stage member 114 may include an outer flange 118 positioned along an outer edge and an inner flange 120 positioned along an inner edge. The upper stage member 116 may include a latch 122 positioned along an outer edge that engages the outer flange 118 of the lower stage member 114, such that the upper stage member 116 couples with the lower stage member 114 along the outer edge of the joint cover system 100. Thus, the first base member 102 is formed when the latch 122 of the upper stage member 116 is coupled to the outer flange 118 of the lower stage member 114. In other embodiments, the upper stage member 116 may be coupled to the lower stage member 114 by other methods of coupling, such as nails, screws, and the like.

The upper stage member 116 may include a strip 124 along an inner edge that is aligned with the inner flange 120 of the lower stage member 114. When the upper stage member 116 is coupled to the lower stage member 114, there may be a slot 126 formed between the inner flange 120 and the strip 124.

The second base member 104 may be substantially identical to the first base member 102 and may include a lower stage member 128, an upper stage member 130, an outer flange 132, an inner flange 134, a latch 136, a strip 138, and a slot 140. These components may be the same as the ones described above for the first base member 102.

The first base member 102 and the second base member 104 may be manufactured from substantially rigid material such as metals, metal alloys, plastics, and the like. Exemplary first and second base members 102, 104 may be manufactured from extruded aluminum.

The first cover plate 106 generally covers or bridges the gap G between building members M1, M2. The first cover plate 106 may be manufactured from bronze, aluminum, steel, stainless steel, galvanized steel, and the like to present any desired appearance. The first cover plate 106 may be positioned within the slots 126, 140 of the first base member 102 and the second base member 104 when the base members 102, 104 are installed on the building members M1, M2. The thickness of the first cover plate 106 may be approximately equal to the size of the opening of the slots 126, 140. Thus, the first cover plate 106 may be held in the slots 126, 140 by frictional forces and may be operable to slide, move, or adjust as the joint expands or contracts. The first cover plate 106 may further include stops 142, 144 along the edges thereof to prevent the first cover plate 106 from being inadvertently detached from the first and second base members 102, 104. The stops 142, 144 may include flanges, rounded or squared protrusions, or the like.

The first intumescent sheet 108 may be a sheet of material as described below with a first edge 143 and a second edge 145 at the opposite end thereof. The first intumescent sheet 108 may include any intumescent material operable to expand and/or swell when exposed to heat. In various embodiments, the first intumescent sheet 108 includes an intumescent material extruded onto a film such as wax paper, mineral wool, artificial fiber ribbons, polyethylene film, polypropylene film, polyurethane film, polyester film, combinations thereof, and the like. In some embodiments, the first intumescent sheet 108 may be comprised of a C.sub.2-C.sub.8 alkyl diamine phosphate fire retardant, as disclosed in U.S. Pat. No. 6,207,085, which is incorporated herein by specific reference.

The first fastener 110 and the second fastener 112 may include nails, staples, screws, rivets, bolts, pins, and/or any other fastening and anchoring elements. Typically, the first fastener 110 and the second fastener 112 have to penetrate the first and second base members 102, 104, the first and second building members M1, M2, or combinations thereof. Thus, the first fastener 110 and the second fastener 112 may be manufactured from rigid or strong materials such as metals, metal alloys, and the like.

Referring to FIG. 1, the first intumescent sheet 108 may be placed in the gap G such that the first and second edges 143, 145 of the first intumescent sheet 108 contact the first side surface S1 of the first building member M1 and the first side surface S5 of the second building member M2. The first intumescent sheet 108 may drape within the gap G such that the intermediate portion of the first intumescent sheet 108 contacts the first end surfaces S3, S7 of the first building member M1 and the second building member M2.

The first base member 102 may be positioned on the first building member M1 such that at least a portion of the lower stage member 114 contacts and overlaps at least a portion of the first edge 143 of the first intumescent sheet 108. Thus, the first edge 143 of the first intumescent sheet 108 is located between the first base member 102 and the first side surface S1 of the first building member M1. The second base member 104 may be positioned on the second building member M2 such that at least a portion of the lower stage member 128 contacts and overlaps at least a portion of the second edge 145 of the first intumescent sheet 108. Hence, the second edge 145 of the first intumescent sheet 108 is located between the second base member 104 and the first side surface S5 of the second building member M2.

The first fastener 110 may penetrate the lower stage member 114 of the first base member 102, the first edge 143 of the first intumescent sheet 108, and the first building member M1 to rigidly retain the first base member 102 and the first edge 143 of the first intumescent sheet 108 to the first building member M1. The first fastener 110 may be positioned between the outer flange 118 and the inner flange 120 of the lower stage member 114 of the first base member 102.

The second fastener 112 may penetrate the lower stage member 128 of the second base member 104, the second edge 145 of the first intumescent sheet 108, and the second building member M2 to rigidly retain the second base member 104 and the second edge 145 of the first intumescent sheet 108 to the second building member M2. The second fastener 112 may be positioned between the outer flange 132 and the inner flange 134 of the lower stage member 128 of the second base member 104. The first cover plate 106 may be slidably positioned in the slots 126, 140 of the first base member 102 and the second base member 104.

Figure 2:
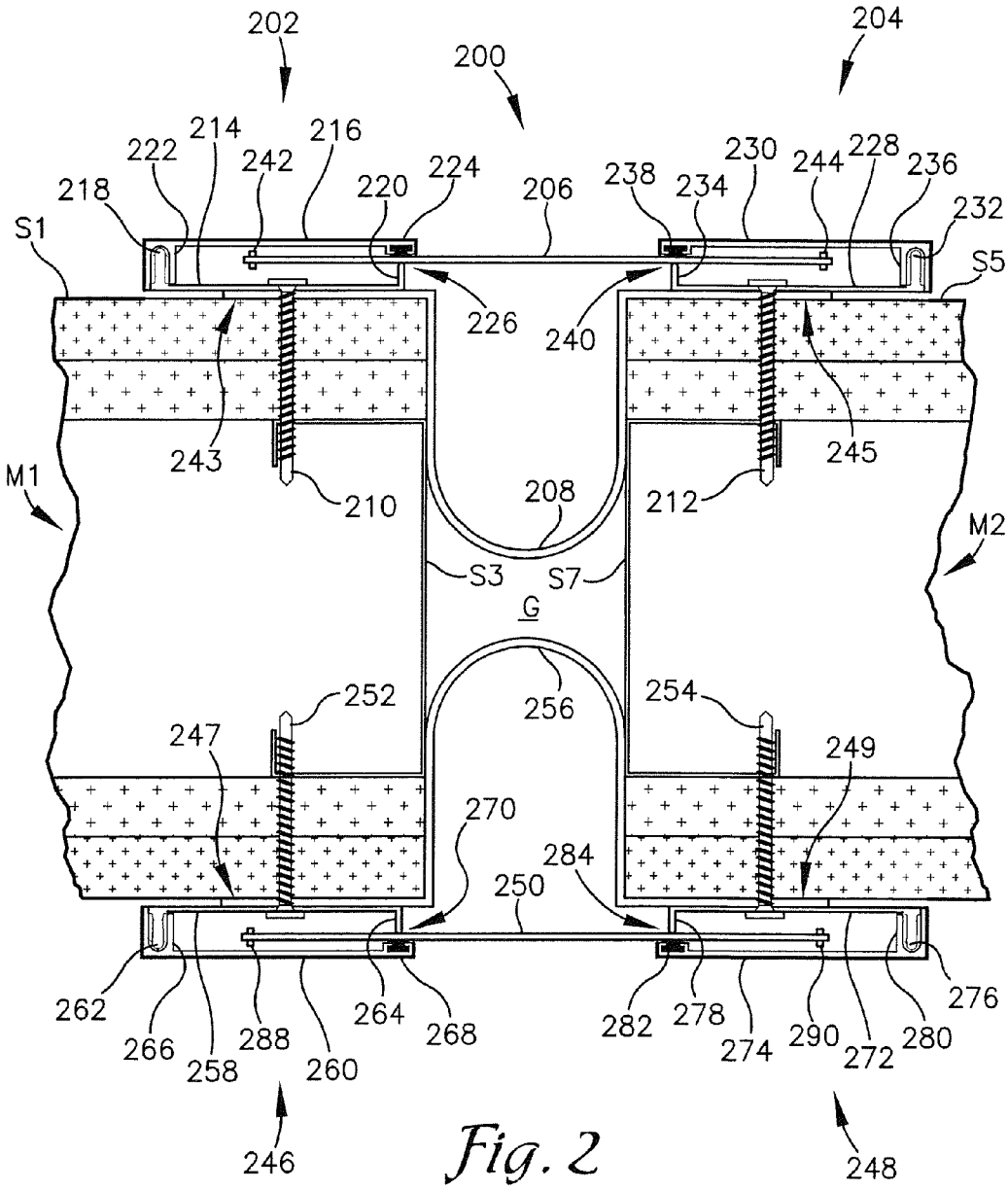
FIG. 2 is a sectional view of a second embodiment of the fire resistive joint cover system.

A second embodiment of the joint cover system 200 is shown in FIG. 2. The joint cover system 200 comprises a first base member 202, a second base member 204, a first cover plate 206, a first intumescent sheet 208, a first fastener 210, a second fastener 212, a third base member 246, a fourth base member 248, a second cover plate 250, a third fastener 252, a fourth fastener 254, and a second intumescent sheet 256. The first base member 202, the second base member 204, the first cover plate 206, the first intumescent sheet 208, the first fastener 210, and the second fastener 212 are all substantially identical to the like-named components of the joint cover system 100.

The first base member 202 may include a lower stage member 214, an upper stage member 216, an outer flange 218, an inner flange 220, a latch 222, a strip 224, and a slot 226. The second base member 204 may include a lower stage member 228, an upper stage member 230, an outer flange 232, an inner flange 234, a latch 236, a strip 238, and a slot 240.

The third base member 246 may be substantially identical to the first and second base members 202, 204 and may include a lower stage member 258, an upper stage member 260, an outer flange 262, an inner flange 264, a latch 266, a strip 268, and a slot 270. The fourth base member 248 may be substantially identical to the first, second, and third base members 202, 204, 246 and may include a lower stage member 272, an upper stage member 274, an outer flange 276, an inner flange 278, a latch 280, a strip 282, and a slot 284.

The third and fourth fasteners 252, 254 may be substantially identical the first and second fasteners 210, 212. The first cover plate 206 may include opposing edge stops 242, 244. The second cover plate 250 may include opposing edge stops 288, 290. The first intumescent sheet 208 may include a first edge 243 and an opposing second edge 245. The second intumescent sheet 256 may be substantially identical to the first intumescent sheet 208 and may include a first edge 247 and an opposing second edge 249.

As seen in FIG. 2, the first and second base members 202, 204, the first cover plate 206, the first intumescent sheet 208, and the first and second fasteners 210, 212 are all implemented as discussed above for the joint cover system 100.

The third and fourth base members 246, 248, the second cover plate 250, the third and fourth fasteners 252, 254, and the second intumescent sheet 256 may be installed on the second side surfaces S2, S6 of the first and second building members M1, M2 in a similar fashion as the other components are installed on the first side surfaces S1, S5 of the first and second building members M1, M2. For example, the second intumescent sheet 256 may be placed in the gap G such that the second intumescent sheet 256 contacts the second side surfaces S2, S6 of the first and second building members M1, M2, as well as the first end surfaces S3, S7. The third base member 246 may be placed on the first building member M1 in contact with the first edge 247 of the second intumescent sheet 256, while the fourth base member 248 may be placed on the second building member M2 in contact with the second edge 249 of the second intumescent sheet 256. The third fastener 252 may penetrate the lower stage member 258 of the third base member 246, the first edge 247 of the second intumescent sheet 256, and the second side surface S2 of the first building member M1. The fourth fastener 254 may penetrate the lower stage member 272 of the fourth base member 248, the second edge 249 of the second intumescent sheet 256, and the second side surface S6 of the second building member M2. The second cover plate 250 may be slidably positioned in the slots 270, 284 of the third base member 246 and the fourth base member 248.

Figure 3:
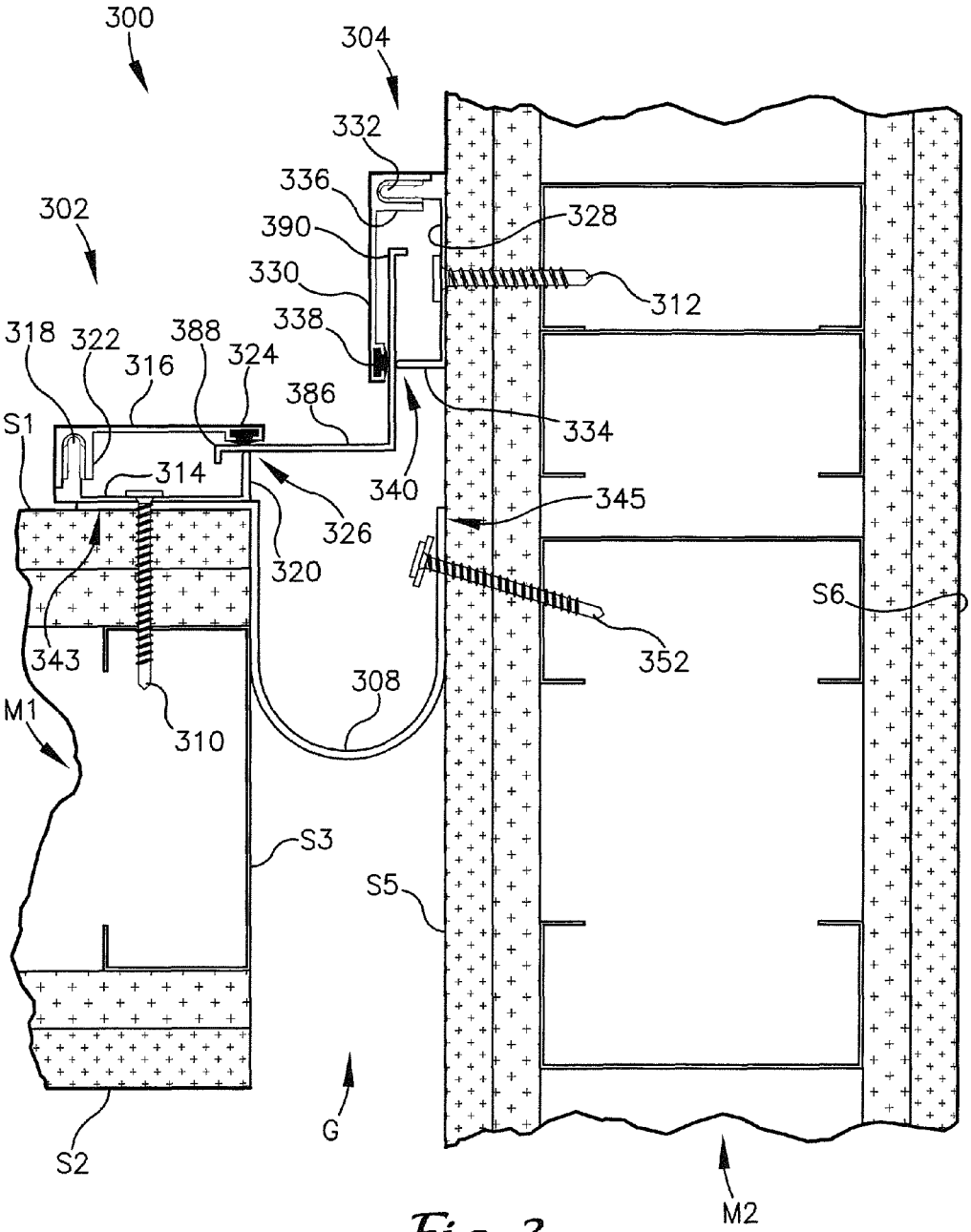
FIG. 3 is a sectional view of a third embodiment of the fire resistive joint cover system.

A third embodiment of the joint cover system 300 is shown in FIG. 3. The joint cover system 300 may be utilized where the first end surface S3 of the first building member M1 intersects the first side surface S5 of the second building member M2. The joint cover system 300 comprises a first base member 302, a second base member 304, a first intumescent sheet 308, a first fastener 310, a second fastener 312, and a third fastener 352 that are substantially identical to the like-named components of the joint cover system 200.

The first base member 302 may include a lower stage member 314, an upper stage member 316, an outer flange 318, an inner flange 320, a latch 322, a strip 324, and a slot 326. The second base member 304 may include a lower stage member 328, an upper stage member 330, an outer flange 332, an inner flange 334, a latch 336, a strip 338, and a slot 340. The first intumescent sheet 308 may include a first edge 343 and an opposing second edge 345.

The joint cover system 300 also includes a cover plate 386, which is similar to the first cover plate 106, except that the cover plate 386 may include an approximate right angle bend along the longitudinal axis thereof. The cover plate 386 may include stops 388, 390 at the outer edges thereof that are generally orthogonal to one another. The cover plate 386 may be inserted into the slots 326, 340 of the first base member 302 and the second base member 304. The cover plate 386 may slide relative to the first building member M1, the second building member M2, or both, if the building members M1, M2 shift positions and the shape of the gap G changes.

Referring to FIG. 3, the first intumescent sheet 308 may be placed in the gap G such that the first edge 343 contacts the first side surface S1 of the first building member M1 and the second edge 345 contacts the first side surface S5 of the second building member M2. A portion of the first intumescent sheet 308 may also contact the first end surface S3 of the first building element M1.

The first base member 302 may be positioned on the first building member M1 such that at least a portion of the lower stage member 314 contacts and overlaps at least a portion of the first edge 343 of the first intumescent sheet 308. The second base member 304 may be positioned on the second building member M2 in proximity to the first base member 302.

The first fastener 310 may penetrate the lower stage member 314 of the first base member 302, the first edge 343 of the first intumescent sheet 308, and the first building member M1 to rigidly retain the first base member 302 and the one edge of the first intumescent sheet 308 to the first building member M1. The first fastener 310 may be positioned between the outer flange 318 and the inner flange 320 of the lower stage member 314 of the first base member 302.

The second fastener 312 may penetrate the lower stage member 328 of the second base member 304 and the second building member M2 to rigidly retain the second base member 304 to the second building member M2. The second fastener 312 may be positioned between the outer flange 332 and the inner flange 334 of the lower stage member 328 of the second base member 304.

The third fastener 352 may penetrate the second edge 345 of the first intumescent sheet 308 and the first side surface S5 of the second building member M2 to rigidly retain the first intumescent sheet 308 to the second building member M2. The cover plate 386 may be slidably positioned within the slots 326, 340 of the first base member 302 and the second base member 304.

Figure 4:
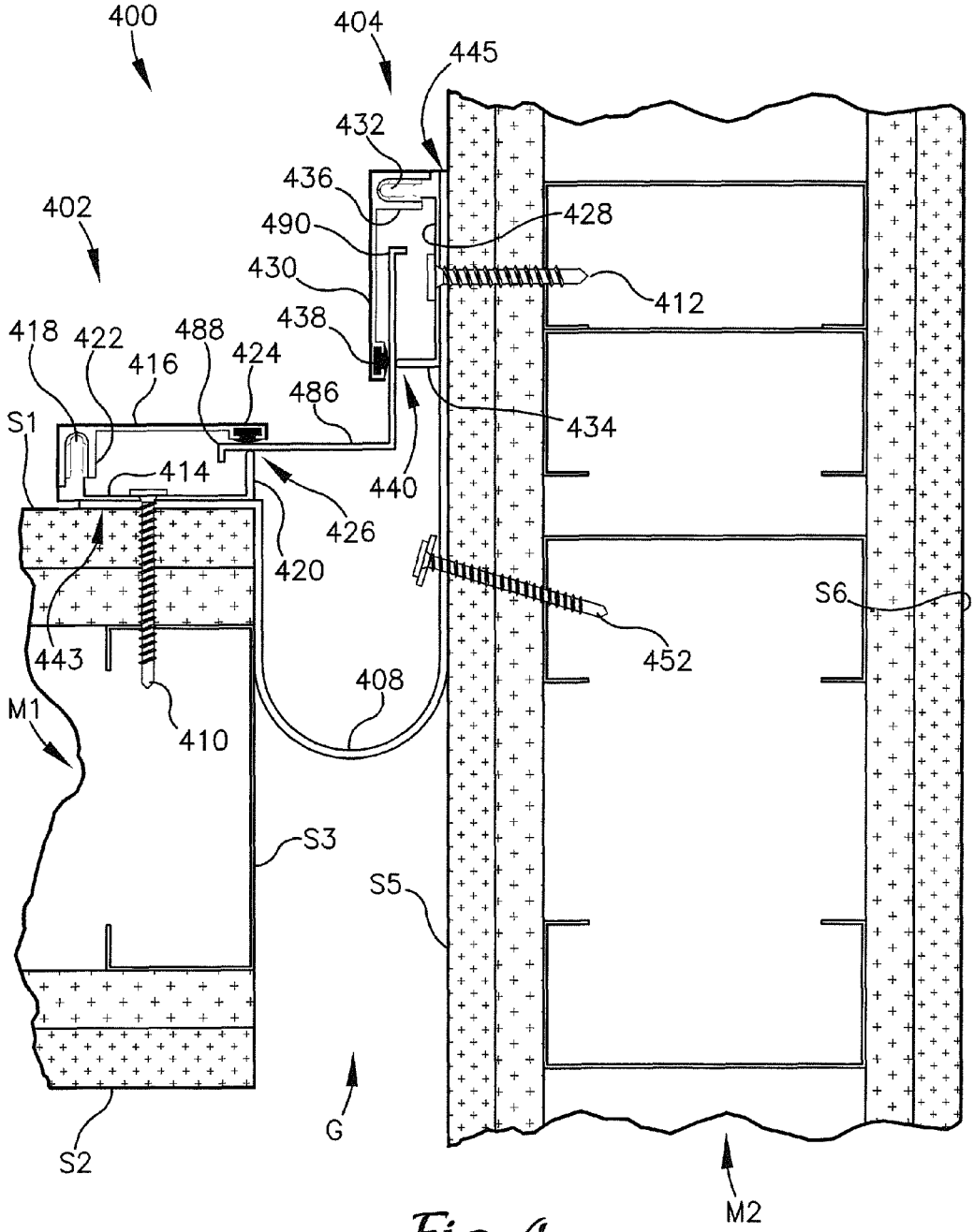
FIG. 4 is a sectional view of a fourth embodiment of the fire resistive joint cover system.

A fourth embodiment of the joint cover system 400 is shown in FIG. 4 and may comprise a first base member 402, a second base member 404, a cover plate 486, a first intumescent sheet 408, a first fastener 410, a second fastener 412, and a third fastener 452. The joint cover system 400 is substantially identical to the joint cover system 300 except that the first intumescent sheet 408 is retained by the second base member 404 as well. The first intumescent sheet 408 of the joint cover system 400 may be wider than the first intumescent sheet 408 of the joint cover system 300 and may contact the first side surface S1 and the first end surface S3 of the first building member M1 along with a greater portion of the first side surface S5 of the second building member M2.

The first base member 402 may include a lower stage member 414, an upper stage member 416, an outer flange 418, an inner flange 420, a latch 422, a strip 424, and a slot 426. The second base member 404 may include a lower stage member 428, an upper stage member 430, an outer flange 432, an inner flange 434, a latch 436, a strip 438, and a slot 440. The cover plate 486 may include stops 488, 490 at opposing ends thereof. The first intumescent sheet 408 may include a first edge 443 and an opposing second edge 445.

Referring to FIG. 4, the first base member 402 may be positioned on the first building member M1 and the first edge 443 of the first intumescent sheet 408, and the third fastener 452 may penetrate the first intumescent sheet 408 and the second building member M2, as described above for the joint cover system 300. The second base member 404 may be positioned on the second building member M2 such that at least a portion of the lower stage member 428 contacts and overlaps at least a portion of the second edge 445 of the first intumescent sheet 408. Hence, the second edge 445 of the first intumescent sheet 408 is located between the second base member 404 and the first side surface S5 of the second building member M2.

The second fastener 412 may penetrate the lower stage member 428 of the second base member 404, the second edge 445 of the first intumescent sheet 408, and the second building member M2 to rigidly retain the second base member 404 and the second edge 445 of the first intumescent sheet 408 to the second building member M2. The second fastener 412 may be positioned between the outer flange 432 and the inner flange 434 of the lower stage member 428 of the second base member 404. The third fastener 452 may penetrate the first intumescent sheet 408 and the second building member M2 at a position spaced apart from the second base member 404. In various embodiments, the position of the third fastener 452 may be aligned with a portion of the first end surface S3 of the first building member M1. The cover plate 486 may be slidably positioned within the slots 426, 440 of the first base member 402 and the second base member 404.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A joint cover system operable to span a gap between two building members, each building member including a planar first side surface and a planar end surface, wherein the end surface of the first building member faces and intersects the first side surface of the second building member, the joint cover system comprising:

a first base member positioned on the first side surface of the first building member, the first base member including a lower wall and a spaced-apart upper wall, such that the lower wall is coupled to the first side surface of the first building member;

a second base member positioned on the first side surface of the second building member, the second base member including a lower wall and a spaced-apart upper wall, such that the lower wall is coupled to the first side surface of the second building member, wherein the lower wall and upper wall of the second base member are oriented at a right angle with respect to the lower wall and upper wall of the first base member;

an intumescent sheet with a first edge positioned between the first base member and the first side surface of the first building member and a second edge positioned on the first side surface of the second building member;

a first fastener penetrating a portion of the first base member, the first edge of the intumescent sheet, and the first side surface of the first building member;

a second fastener penetrating a portion of the second base member and the first side surface of the second building member; and a third fastener penetrating the second edge of the intumescent sheet and the first side surface of the second building member.

2. The joint cover system of claim 1, further including a cover plate with a right angle bend along the longitudinal axis thereof slidably coupled with the first base member and the second base member.

3. The joint cover system of claim 2, wherein the first base member and the second base member both include a slot in which the cover plate is slidably coupled.

4. The joint cover system of claim 1, wherein the intumescent sheet contacts the end surface of the first building member.

5. A joint cover system operable to span a gap between two building members, each building member including a planar first side surface and a planar end surface, wherein the end surface of the first building member faces and intersects the first side surface of the second building member, the joint cover system comprising:

a first base member including a base wall coupled to the first side surface of the first building member;

a second base member including a base wall coupled to the first side surface of the second building member, wherein the base wall of the second base member is oriented at a right angle with respect to the base wall of the first base member;

an intumescent sheet with a first edge positioned between the first base member and the first side surface of the first building member and a second edge positioned on the first side surface of the second building member;

a first fastener penetrating a portion of the first base member, the first edge of the intumescent sheet, and the first side surface of the first building member;

a second fastener penetrating a portion of the second base member and the first side surface of the second building member;

a third fastener penetrating the second edge of the intumescent sheet and the first side surface of the second building member; and a cover plate with a right angle bend along the longitudinal axis thereof, the cover plate including a first edge slidably coupled with the first base member and an opposing second edge oriented at a right angle with respect to the first edge and slidably coupled with the second base member.

* * * * *